United States Patent [19]

Irwin

[11] 4,218,856

[45] Aug. 26, 1980

[54] CONNECTOR FOR SLOPED ROOF DECK

[76] Inventor: John W. Irwin, P.O. Box 4753, Clearwater, Fla. 33518

[21] Appl. No.: 945,090

[22] Filed: Sep. 25, 1978

[51] Int. Cl.[2] ..... E04B 7/04; F16B 9/00

[52] U.S. Cl. ..... 52/90; 52/696; 52/702; 52/715; 403/232.1

[58] Field of Search ..... 52/90, 92, 93, 715, 52/702, 357, 359, 360, 696, 454; 403/232.1

[56] References Cited

U.S. PATENT DOCUMENTS

| | | | |
|---|---|---|---|
| 1,406,723 | 2/1922 | Caldwell | 403/232.1 |
| 1,458,770 | 6/1923 | Marks | 52/454 X |
| 3,298,151 | 1/1967 | Jureit | 52/696 X |
| 3,747,290 | 7/1973 | Barrell et al. | 52/93 X |
| 4,090,336 | 5/1978 | Carroll | 52/309.12 |

FOREIGN PATENT DOCUMENTS

| | | | |
|---|---|---|---|
| 1266491 | 3/1972 | United Kingdom | 52/90 |

*Primary Examiner*—Ernest R. Purser
*Attorney, Agent, or Firm*—Stein & Frijouf

[57] ABSTRACT

The invention comprises an improved connector for providing a sloped roof deck between horizontal joists and a plurality of roof trusses. A plurality of sets of integral connectors are used for connecting the roof trusses to the joists with the roof trusses being in a parallel array and perpendicular to the joists. Each of the integral connectors has a base element for mounting to the joist and a support element for mounting to the roof truss with a coupling means disposed therebetween. Each set of connectors has a discrete size coupling means to dispose the support elements at different heights relative to the base elements thereby sloping the roof trusses at the acute angle relative to a horizontal. The sloped roof deck generally comprises a plurality of sheet members disposed between adjacent roof trusses of the parallel array. A hardenable roof material such as concrete or gypsum is disposed upon the plurality of sheet members and bonded to the roof trusses resulting in a sloped roof of high structural strength. The foregoing abstract is merely a resume of one general application, is not a complete discussion of all principles of operation or applications, and is not to be construed as a limitation on the scope of the claimed subject matter.

6 Claims, 11 Drawing Figures

CONNECTOR FOR SLOPED ROOF DECK

BACKGROUND OF THE INVENTION

1. Field of the Invention

This invention relates to roof structures and more particularly to novel connectors for providing a sloped roof deck.

2. Description of the Prior Art

One of the common problems involved in the construction of a sloped roof deck is the angling of the roof trusses relative to the horizontal joists. Various types of clips and clamping assemblies have been devised for both residential and commercial roof structures. The majority of this prior art relates to the interconnection of joists and roof trusses of residential buildings. In residential buildings, the roof trusses are generally made of wood which trusses are nailed or bolted to a clip assembly for establishing the roof trusses at a preferred roof angle. The roof angle of most residential buildings are established by code, regulation or custom. Accordingly, only a limited number of different clip assemblies need be manufactured for residential buildings.

A commercial roof is entirely distinct from a roof generally found on a residential building. A residential roof normally comprises wooden trusses which are covered by a sheeting material which is overlayed by shingles or tile. The roof must be sloped properly to enable drainage of water over the shingles or tile. A commercial roof is built as an integral unit which in many cases may be completely horizontal. The slopes of commercial roofs find a wide variation from no slope to an acute slope depending upon the design and application of the building. Accordingly there is an absence of a simple and inexpensive slope clip which satisfies the needs of builders.

Therefore it is an object of this invention to provide an apparatus which overcomes the aforementioned inadequacies of the prior art devices and provides an improvement which is a significant contribution to the advancement of the roofing art.

Another object of this invention is to provide an improved connector for use between a joist and a truss comprising a base element for mounting to the joist and a support element for mounting to the truss. A discrete length coupling means interconnects the support element to the base element such that a plurality of connectors provide a slope to the roof truss.

Another object of this invention is to provide an improved connector for use between a joist and a truss wherein the base element and the supporting element form a one-piece structure with the coupling means.

Another object of this invention is to provide an improved connector for use between a joist and a truss wherein the coupling means is formed by plural bends in an integral piece of metal with the base element and the support element being formed by similar bends in the metal material.

Another object of this invention is to provide an improved sloped roof deck comprising horizontal joists and a plurality of roof trusses with a plurality of integral connectors connecting the plurality of roof trusses to the joists. A plurality of sheet members are disposed between adjacent roof trusses for receiving a hardened roof material thereon to be bonded to the roof trusses.

Another object of this invention is to provide an improved coupling device for use with a sloped roof deck which is adapatable to most existing methods and systems of commercial roof fabrication.

Another object of this invention is to provide an improved sloped roof deck comprising a base of reinforced metallic sheet with a rigid board material overlying the reinforced metallic sheet. The roof deck further includes a reinforcing mesh disposed to overlay the rigid board material and the roof trusses with a hardened roof material bonded to the mesh and the roof trusses and the rigid board material.

Another object of this invention is to provide an improved connector device for providing a sloped roof truss which is inexpensive and may be readily stocked for commercial roof decks.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment, in addition to the scope of the invention defined by the claims, taken in conjunction with the accompanying drawings.

SUMMARY OF THE INVENTION

The invention may be incorporated into a connector for use between a joist and a truss in addition to an improved sloped roof deck incorporating the improved connector device. The improved connector comprises a base element for mounting to the joist and a support element for mounting to the truss. Coupling means mounts the support element to the base element with the support element forming a one-piece structure. The coupling means includes a first and a second coupling element which are perpendicular to one another. The first and second coupling elements are respectively perpendicular to the base element and the support element. Each of the first and second coupling elements may be triangular structures.

In a more specific embodiment of the invention, the coupling means comprises a parallelogram with a perpendicular bend extending along a line intersecting two opposed corners thereby forming two triangular elements. The first coupling element is substantially perpendicular to the second coupling element and the base element. The second coupling element is substantially perpendicular to the support element. The base and the support elements each comprise a substantially rectangular configuration.

The invention is also included within an improved sloped roof deck comprising a plurality of horizontal joists and a plurality of roof trusses. A plurality of sets of integral connectors as heretofore described connect the plurality of roof trusses to the joists such that the roof trusses are in a parallel array and perpendicular to the joists. Each of the integral connectors has the base element mounted to a joist and the support element mounted to a roof truss. Each of the sets of integral connectors have discrete size coupling members for establishing the roof trusses at an acute angle relative to the horizontal joists. A plurality of sheet members are disposed between adjacent roof trusses in the parallel array. A curable roof material is disposed on the plurality of sheet members and is bonded to the roof trusses resulting in a sloped roof of high structural strength. The sheet material may comprise a reinforced metal sheet such as galvanized or painted corrogated metal which may be layed and welded to the trusses. A rigid board material is disposed between adjacent roof trusses to overlay the reinforced metal sheet. A reinforcing mesh is disposed to overlay both the rigid board material and the roof trusses enabling the curable roofing material such as lightweight concrete or gypsum to bond to both the rigid board material, the reinforcing mesh and the roof trusses.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention reference should be had to the following detailed description taken in connection with the accompanying drawings in which.

Figure 1:
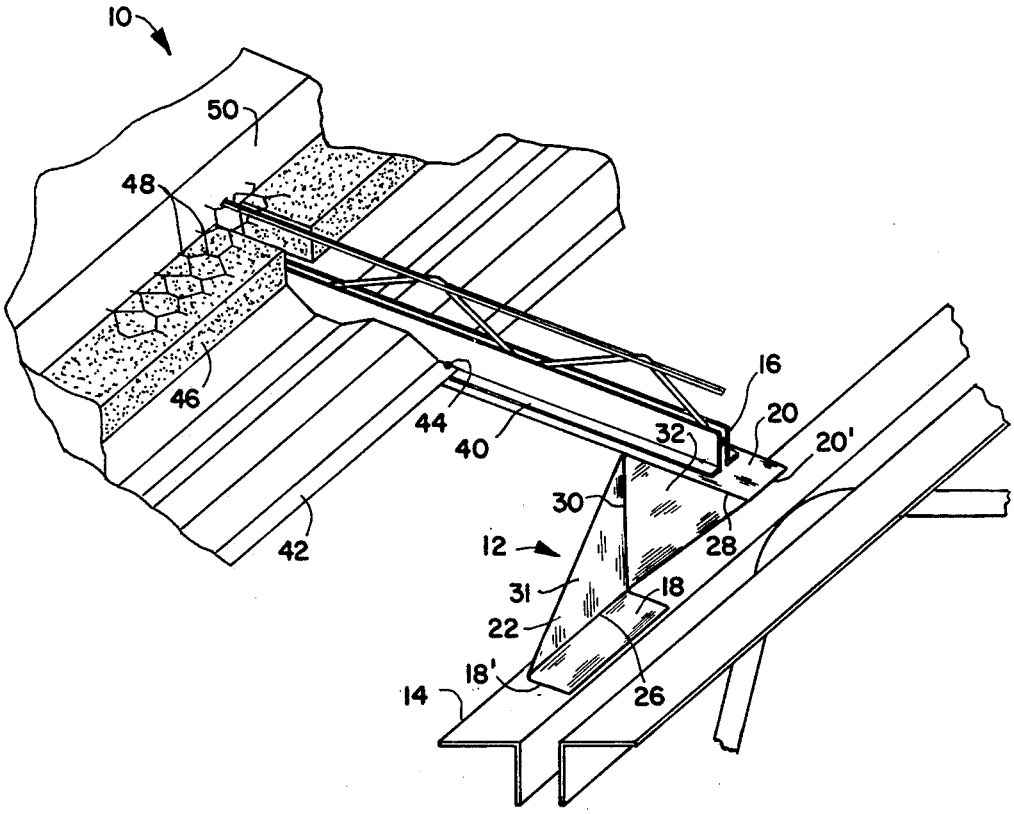
FIG. 1 is a perspective view of the new connector device installed on the improved roof deck.

Similar reference characters refer to similar parts throughout the several views of the drawings. For a more clearer understanding of the invention, the following number identifications taken in conjunction with the detailed description of the drawings set forth the preferred mode or practice of the invention:

| | | | |
|---|---|---|---|
| 10 | roof deck system | 30 | bend |
| 10A | roof deck system | 31 | first coupling element |
| 12 | connector | 32 | second coupling element |
| 12A | connector | 34 | weld |
| 12B | connector | 36 | weld |

-continued

| | | | |
|---|---|---|---|
| 12C | connector | 38 | weld |
| 14 | joist | 40 | shoulder |
| 16 | truss | 40A | shoulder |
| 16A | truss | 40B | shoulder |
| 18 | base element | 42 | reinforced metal sheet |
| 18' | dimension | 44 | weld |
| 20 | support element | 46 | rigid board |
| 20' | dimension | 46A | rigid board |
| 22 | coupling means | 46B | rigid board |
| 22A | coupling means | 48 | reinforcing mesh |
| 22B | coupling means | 50 | roofing material |
| 22C | coupling means | 56A | recess |
| 26 | bend | 56B | recess |
| 28 | bend | 60 | sealing material |

DETAILED DESCRIPTION

Figure 2:
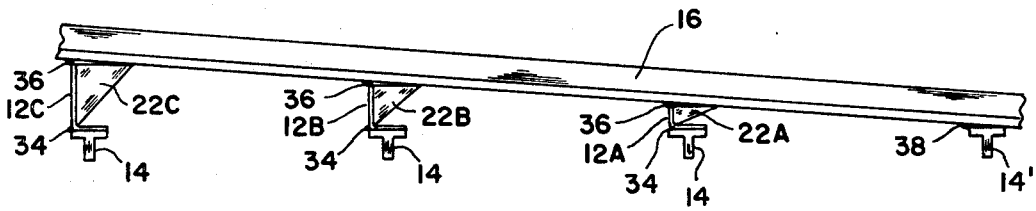
FIG. 2 is a side elevational view of a set of connectors supporting a roof truss from a plurality of joists.

FIG. 1 is a perspective view of an improved roof deck system 10 for providing a sloped roof deck for a commercial building. Although the disclosed invention is set forth primarily for a commercial building, it should be understood that the instant invention may find application in residential and other types of building structures. The roof deck system 10 comprises a novel connector 12 for interconnecting a joist 14 and a truss 16. Joists 14 are normally mounted in a parallel array as shown in FIG. 2 and are generally metallic T-joists for supporting the roof structure. The truss 16 is shown as a truss tee or a bulb tee subpurlin which is mounted perpendicularly to the joists as shown in FIG. 2. A plurality of trusses (one shown in FIGS. 1 and 2) form a parallel array perpendicular to the joists 14 as is well known in the art. The trusses 16 have preferably a four foot spacing between adjacent trusses 16 for supporting the improved roof deck 10.

The connector 12 is more fully shown in FIGS. 2–10 as comprising a set of connectors 12A, 12B and 12C. The connector 12B is more fully shown in FIGS. 3–7 as comprising a base element 18 and a support element 20 each being substantially rectangular. The dimensions 18' and 20' are selected to be in accordance with the width of the joist 14 and the truss 16 as is more fully shown in FIGS. 1 and 2. The connector 12 comprises a coupling means 22 shown more fully as 22A, 22B and 22C in FIGS. 2 and 8–10. The coupling means 22B comprises a parallelogram defined by bends 26 and 28 which are parallel to the terminating edges of the base and support elements 18 and 20. Bends 26 and 28 are preferably right angle bends as shown in FIGS. 4–7. A third bend 30 extends along a line intersecting two opposed corners of the parallelogram thereby defining first and second triangular coupling elements 31 and 32. The bend 30 is preferably a perpendicular bend.

Figure 8:
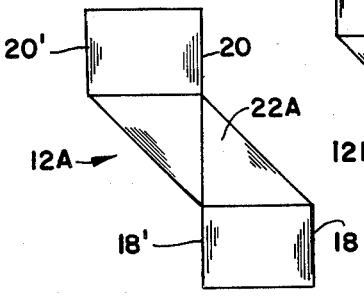
FIG. 8 is a plan view of a first of a set of the improved connector devices.
Figure 9:
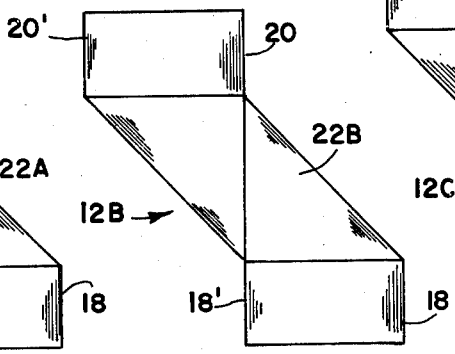
FIG. 9 is a plan view of a second of a set of the improved connector devices.
Figure 10:
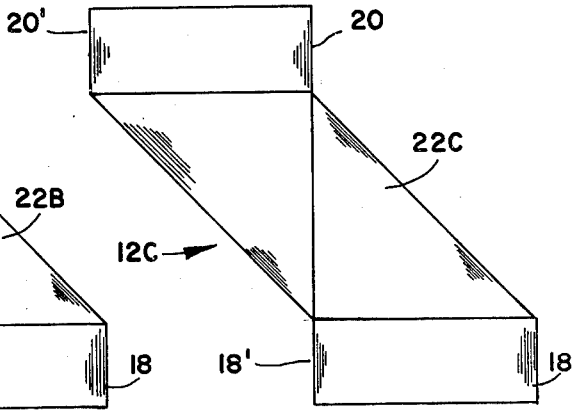
FIG. 10 is a plan view of a third set of a set of the improved connector devices.

FIGS. 2 and 8–10 illustrate the set of connectors 12A–12C having base elements 18 and support elements 20 with a substantially constant dimension 18' and 20'. The dimension of the coupling means 22 varies as shown in FIGS. 8–10 enabling a set of connectors 12A–12C to provide a slope to the roof truss 16 as illustrated in FIG. 2. The base elements 18 are secured to the joists 14 by welds 34 whereas the support elements 20 are welded to the roof trusses by welds 36. The joist 14 is directly welded to joist 14' by a weld 38 in FIG. 2. The selection of a set of connectors 12 with coupling means 22A–22C provides the slope to the roof truss 16.

The roof deck 10 is completed by placing sheet members between adjacent trusses 16 of the parallel roof truss array. Each of the roof trusses 16 includes shoulders 40 for preferably receiving a reinforced metal sheet 42 which may be galvanized or painted corrugated metal or similar material. The reinforced metal sheet 42 is welded to the roof truss 16 by welds 44. It should be understood that the opposed side of the reinforced metallic sheet 42 is similarly secured to the next adjacent roof truss 16.

A rigid board 46 is interposed between adjacent roof trusses 16 to overlay the reinforced metal sheet 42. The rigid board 46 is preferably a polystyrene vent board of a given thickness depending upon the characteristics and requirements of the building structure. Preferably, the vent board is 48 inches wide to be exactly received within the adjacent roof trusses 16. A reinforcing mesh 48 is disposed to overlay both the rigid board 46 and the roof trusses 16. The reinforced mesh 48 may be key deck wire mesh which is hog-ringed to the truss tee 16. The curable roofing material 50 which may be gypsum, pyrolfill, lightweight insulating concrete or the like, is bonded to the reinforcing mesh 48, the roof truss 16 and the rigid board 46. The curing of the roofing material 50 provides a lightweight and strong sloped roof system.

Figure 11:
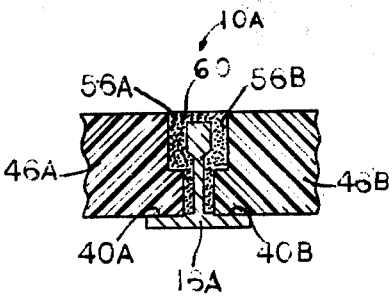
FIG. 11 is a sectional view of a variation of the improved roof deck shown in FIG. 1.
Figure 3:
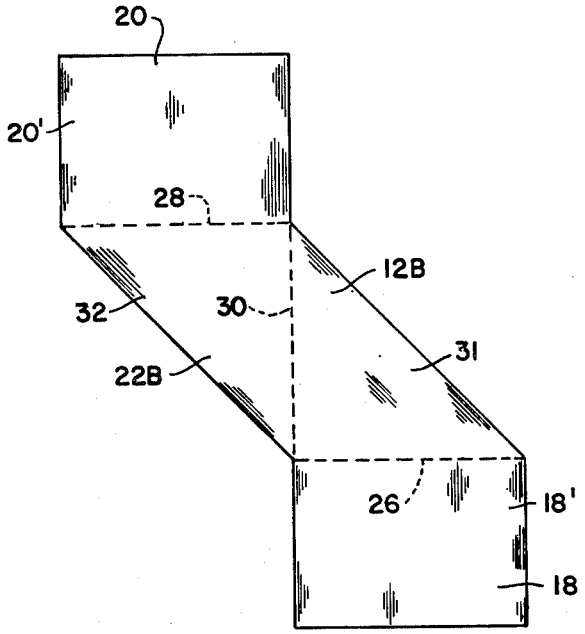
FIG. 3 is a plan view of a sheet metal blank for making the improved connector device shown in FIGS. 1 and 2.
Figure 4:
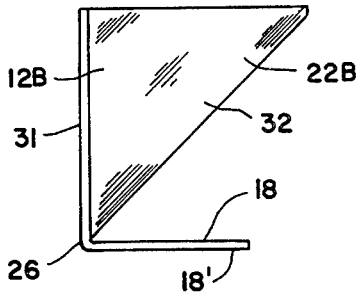
FIG. 4 is a side view along line 4—4 in FIG. 1 of the blank shown in FIG. 3.
Figure 5:
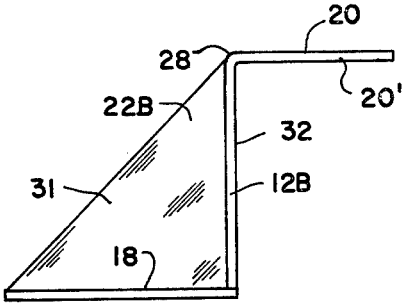
FIG. 5 is a front view along line 5—5 of the connector shown in FIG. 1.
Figure 6:
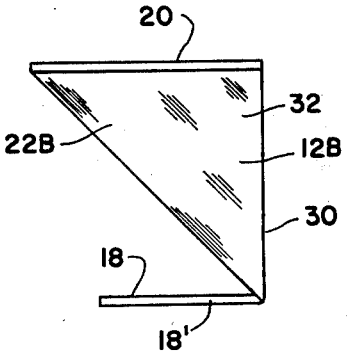
FIG. 6 is a side view along line 6—6 of the connector device shown in FIG. 1.
Figure 7:
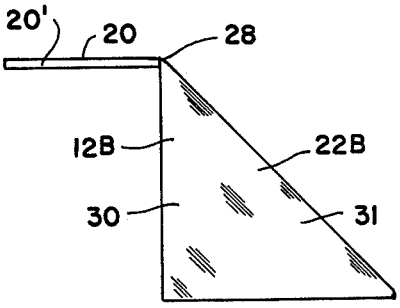
FIG. 7 is a rear view of the connector shown in FIG. 1.

FIG. 11 is a sectional view of an improved roof deck 10A which is a variation of the roof deck shown in FIG. 1. In this embodiment, shoulders 40A and 40B of truss 16A respectively support rigid boards 46A and 46B. Each of the rigid boards 46A and 46B has a recess 56A and 56B for receiving an adhesive or sealing material 60 to bond the rigid boards 45A and 46B to truss 16A. It should be understood that the embodiment shown in FIG. 11 is preferably used with the connectors shown in FIGS. 1–10.

The foregoing has described an improved roofing deck 10 and 10A in addition to a novel connector 12 which provides a slope to a commercial roofing deck. In many instances, the materials and specifications of the roof has been set forth in explicit detail. It should be appreciated by those skilled in the art that numerous variations, modifications, substitutions and changes in material may be resorted to within the scope of the invention. All of these variations, modifications, substitutions and changes in material and the like are construed to be part of the invention. The detailed disclosure has been presented to merely reveal one mode of practicing the invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. An improved connector for use between a joint and a truss, comprising in combination:

a base plate for mounting to the joist;

a support plate for mounting to the truss;

coupling means in the form of a half box support column made by the process of providing a parallelogram shaped and folding into first and second identical triangular portions joined into perpendicular planar relationship along a bend line intersecting two opposed corners;

said plates connected to similar bases of the first and second triangular portions with said bend line extending perpendicular to both of the bases to which the plates are attached; and said base and support plates lying in parallel superimposed relationship; and whereby the connector may be seated on a joist and the truss seated on the connector with the weight supported in compression through said coupling means.

2. An improved connector as set forth in claim 1, wherein each of said base and support plates are substantially rectangular.

3. An improved sloped roof deck, comprising in combination:

a plurality of horizontal joists disposed in a parallel array;

a plurality of roof trusses;

a plurality of sets of integral connectors for respectively connecting said plurality of roof trusses to said plurality of horizontal joists in a parallel array and perpendicular to said horizontal joists;

each of said integral connectors comprising a base element for mounting to a roof truss with coupling means integrally disposed therebetween;

each of said plurality of sets of integral connectors comprising a base plate for mounting the joists, a support plate for mounting to the truss, coupling means in the form of a half box support column made by the process of providing a parallelogram shaped blank and folding into first and second triangular portions joined into perpendicular planar relationship along a bend line interconnecting two opposed corners, said plates connected to similar bases of the first and second triangular portions with said bend line extending perpendicular to both of the bases to which the plates are attached;

a plurality of sheet members disposed between adjacent roof trusses of said parallel array; and a roof material disposed upon said plurality of sheet members and bonded to said sheet members and said roof trusses providing a sloped roof deck of high structural strength.

4. An improved sloped roof deck as set forth in claim 3, wherein each of said coupling members has a discrete height between said base element and said support element.

5. An improved slope roof deck as set forth in claim 4, wherein each of said base plates and said support plates are substantially uniform in size.

6. An improved sloped roof deck as set forth in claim 3, wherein said plate is substantially parallel to said support plate for each of said integral connectors.

* * * * *